United States Patent [19]

Fuerst

[11] Patent Number: 4,527,500

[45] Date of Patent: Jul. 9, 1985

[54] SEALING MAT FOR HULL BREACHES

[76] Inventor: Erwin J. Fuerst, 1183 N. River Rd., St. Clair, Mich. 48079

[21] Appl. No.: 521,996

[22] Filed: Aug. 11, 1983

[51] Int. Cl.[3] ..... B63B 43/16

[52] U.S. Cl. ..... 114/229

[58] Field of Search ..... 114/227, 228, 229, 222; 156/94, 391; 81/15.7; 4/583

[56] References Cited

U.S. PATENT DOCUMENTS

| | | | |
|---|---|---|---|
| 352,275 | 11/1886 | Speirs | 114/229 |
| 770,078 | 9/1904 | Kruger | 114/229 |
| 1,306,938 | 6/1919 | Achiha | 114/229 |
| 1,550,144 | 8/1925 | Blumberg | 114/229 |
| 2,220,085 | 11/1940 | Dirschel | 114/227 |
| 2,987,098 | 6/1961 | Daniel | 114/229 |
| 3,091,779 | 6/1963 | Lucas et al. | 4/583 |
| 4,328,761 | 5/1982 | Dwyer | 114/222 |

FOREIGN PATENT DOCUMENTS

| | | | |
|---|---|---|---|
| 1283347 | 5/1962 | France | 114/229 |

*Primary Examiner*—Trygve M. Blix
*Assistant Examiner*—Stephen P. Avila
*Attorney, Agent, or Firm*—Barnes, Kisselle, Raisch, Choate, Whittemore & Hulbert

[57] ABSTRACT

A device for temporary application to the hull of small craft to close accidental breaches in the hull which includes a mat having a raised annular wall to surround and close off a breach from the water surrounding the hull. Suction cups are arranged on the mat around the wall to hold the mat against the hull. Reinforcing ribs can prevent pressure collapse of the mat within the wall and internal mechanical fastenings may supplement the action of the suction cups.

1 Claim, 7 Drawing Figures

SEALING MAT FOR HULL BREACHES

FIELD OF THE INVENTION

Devices for temporary application to the hull of small craft to close accidental breaches in the hull.

BACKGROUND OF THE INVENTION

Small power and sail boats of the pleasure craft variety as well as other small craft are subject to accidental breach openings in the areas below the water line due to contact with submerged objects. Accidental hull breaches are usually caused by striking flotsam, underwater obstructions such as piers, pipes, wrecks, rocks or corral, or afterdemasting. Unless immediate action is taken, the breach may result in loss of the entire boat and contents and possible loss of life.

Very frequently, pleasure boats are fitted in the interior with bunks, iceboxes, shelves, insulating walls and storage cabinets and other compartments which prevent immediate access to the breach from the inside of the boat. A mere 1½" hole 2 feet under water level will allow water to enter the boat a rate of about 71 gallons a minute. The average electric bilge pump in a 35-foot boat has a capacity of only about 33 gallons per minute. Accordingly, it is desirable to have an emergency device for application to a breach which will allow the craft to reach port where repairs may be made. Because of the difficulties of access within the boat, it is almost a necessity to go overboard to locate the hole. Secondly, a stoppage of the breach is required without delay to avoid sinking. It is not uncommon for a crew member to go overboard to check an anchor setting, and face masks are available for this as well as the usual underwater exploration.

It is an object of the present invention to provide a relatively inexpensive device which can be readily stored and easily applied to a breach from the outside of a hull. It is also an object to provide a closure device which will adapt to the various curvatures of a hull and still provide an adequate seal. Another object is the provision of a closure which carries its own adherance devices with no mechanical devices which need to be manipulated from within the hull.

Other objects of the invention will be apparent in the following description and claims in which the invention is described together with details to enable persons skilled in the art to practice the invention, all in connection with the best mode presently contemplated for the invention.

BRIEF DESCRIPTION OF THE DRAWINGS

Drawings accompany the disclosure and the various views thereof may be briefly described as.

DETAILED DESCRIPTION OF THE INVENTION AND THE MANNER AND PROCESS OF USING IT

Figure 1:
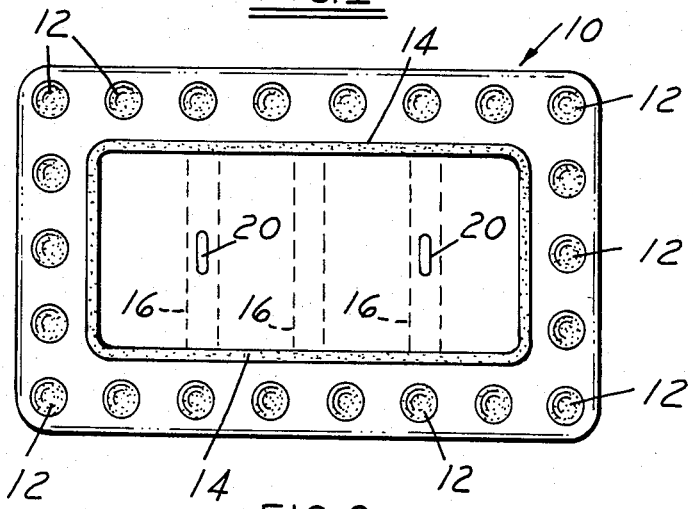
FIG. 1, an elevation of the device constructed according to the invention.
Figure 2:
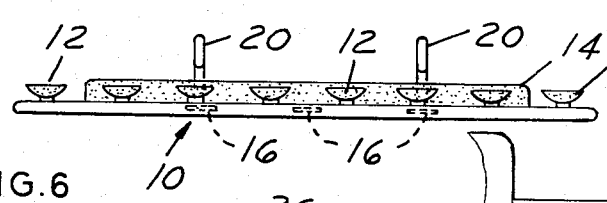
FIG. 2, an edge side view of the device illustrated in FIG. 1.
Figure 7:
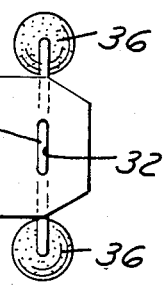
FIG. 7, a plan view of the device of FIG. 6.

The device according to the present invention comprises a flexible mat formed of natural rubber, synthetic rubber or a relatively soft flexible plastic. On one side of the mat around the periphery is a plurality of suction cups. Within the border of suction cups is a continuous wall which will form a closure in contact with the hull surrounding the breach.

With reference to the drawings, a flexible and pliable rectangular mat 10 has within its periphery a series of spaced suction cups 12 forming a border around the mat on one side. Within the border of suction cups is an elevated, continuous wall or rim 14 which is formed of a soft compressible material or foam rubber having a height above the mat surface a little higher than that of the suction cups. The area within the rim 14 represents the maximum area of hull defect which can be covered. Mats of varying sizes can be provided in the emergency equipment.

The mat is reinforced transversely by elastic metal or plastic stays 16 embedded in the mat 10 which prevent a collapse of the mat when subjected to outside water pressure. Anchored in the stays 16 are rings 20 which can project through a breach in the hull and are useful in securing the mat from the inside of the hull when accessible. The inward force on the mat is proportional to the distance from the water line and the size of the breach. The rings 20 can be flexible so that they may fold into the chamber formed by the rim 14 if they will not protrude through the breach.

In the use of the safety mat, the mat 10 can be stored with the suction cups 12 and rim 14 outward and preferably protected by a covering. When a breach is detected and located, the mat is placed next to the hull defect and rolled over it to provide an instant seal. Pressure applied on the outside of the mat along the margins secures the suction cups firmly to the hull. Most modern hulls today when properly maintained have a smooth surface to which the suction cups will firmly ahdere.

The differential between the hydrostatic pressure (the deeper the defect, the higher the pressure) and the atmospheric pressure within the boat causes the mat to be pressed against the hull. The suction cups secure the mat in the event the boat or wave motion should expose the mat momentarily above the water.

Once the in-flow of water is stopped, the bilge pump can evacuate the boat. If the boat is a distance away from port, it may be desirable to secure the rings 20 from within before proceeding.

Figure 6:
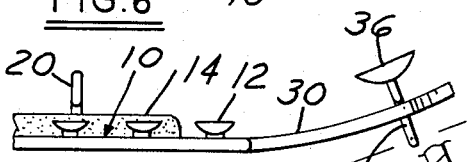
FIG. 6, a side view of a modification to assist in installation.
Figure 4:
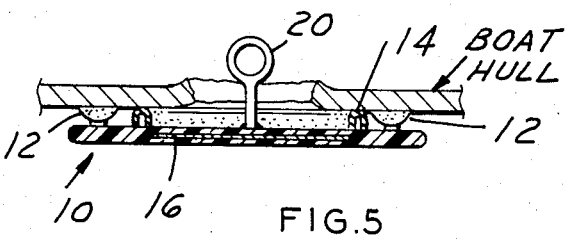
FIG. 4, a transverse sectional view on line 4—4 of FIG. 3.
Figure 5:
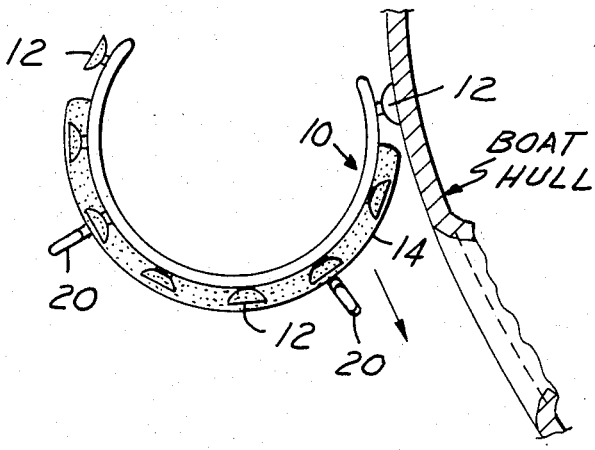
FIG. 5, a view showing how the device is applied externally of the hull.
Figure 3:
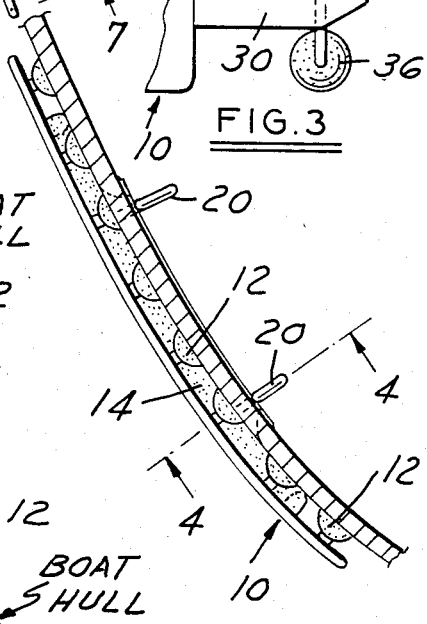
FIG. 3, a view illustrating the device applied to a hull breach.

In FIG. 6, a modification is illustrated to facilitate positioning of the device. In still water, there is little problem in installing the mat over a breach. In rough water more difficulty can be experienced. The addition of a tongue extension 30 on the device provides an aid to installation. The tongue 30 has a slot 32 which receives a handle 34 on a bridge between two relatively large suction cups 36. The handle can be readily grasped on the outside of the mat and used to control the mat and affix it to the hull while it is being properly positioned. The bridged suction cup unit with handle 34 and cups 36 is a commercially available device.

What is claimed is:

1. A safety mat for temporary emergency closure of a hull breach of a boat which comprises:

(a) a relatively flat mat of pliable material flexible in a manner to conform to a hull curved in directions normal to each other, (b) a continuous, closed sealing rim of flexible material raised from the general plane of one side of the mat a predetermined distance from said mat to surround and conform to a hull surface outside a hull breach below the water line of the boat, said rim being positioned a predetermined distance within the margins of the mat, (c) a pluraity of flexible suction cups arranged in closely spaced relation on said mat along the said sealing rim outside, and on the same side of said mat, as said rim and around and between said rim and the margins of the mat to secure the mat and the sealing rim to a hull surrounding a breach, and (d) a flexible tongue extending from the edge of said mat having a slot to receive the handle intermediate bridged suction cups, said tongue and said bridged suction cups serving to facilitate initial location of said mat adjacent a hull breach.

* * * * *